United States Patent [19]

Elliott

[11] Patent Number: 4,699,196

[45] Date of Patent: Oct. 13, 1987

[54] ADJUSTABLE VENETIAN BLIND

[76] Inventor: James E. Elliott, 469 Ena Rd., No. 1405, Honolulu, Hi. 96815

[21] Appl. No.: 705,441

[22] Filed: Feb. 25, 1985

[51] Int. Cl.[4] ..... E06B 9/30

[52] U.S. Cl. ..... 160/168 R

[58] Field of Search ..... 160/166, 168 R, 169, 160/170, 171, 172

[56] References Cited

U.S. PATENT DOCUMENTS

| | | | |
|---|---|---|---|
| 1,949,653 | 3/1934 | Moore | 160/168 X |
| 2,745,486 | 5/1956 | Nelson | 160/166 R |
| 2,837,152 | 6/1958 | Moore, Jr. | 160/168 |

*Primary Examiner*—Robert W. Gibson, Jr.
*Attorney, Agent, or Firm*—George W. T. Loo

[57] ABSTRACT

A width adjustable Venetian blind that is extendible within limits. The blind includes a telescopic head channel assembly, a telescopic tilt rod assembly, a slat assembly, and a telescopic bottom rail assembly. The head channel assembly includes a central channel and sliding right and left channels. The tilt rod assembly includes a tilt rod body, two sliding tilt rod extensions, and two retaining clips to retain it in the head channel assembly. The slat assembly includes a series of vertically spaced slats. Each slat includes two slat components that overlap each other and are slidably secured to each other by two slat clips. The bottom rail assembly includes a bottom rail body and two sliding bottom rail extensions. At least three axially spaced ladder drum assemblies encircle a portion of the tilt rod assembly with at least three ladders depending therefrom. Each ladder supports the slats on its rungs. The bottom rail assembly is connected to the ends of the ladders. The blind is installed within two support brackets, which have an entrance in one of their sides. After right and left channels of the head channel assembly are extended into the support brackets, a locking tab tip is inserted into a hole in the right and left channels to secure them to the central channel. The extension of the head channel assembly causes the corresponding extension of the tilt rod, slat, and the bottom rail assemblies.

7 Claims, 12 Drawing Figures

ADJUSTABLE VENETIAN BLIND

BACKGROUND OF THE INVENTION

1. Field of Invention.

This invention relates to horizontally adjustable Venetian blinds.

2. Description of the Prior Art.

Ready-made blinds are manufactured in fixed sizes of one inch increments. This requires 70–80 different sizes per color to try to meet the consumer's needs. Because of the cost and space requirements, only a few colors can be offered by the manufacturer and distributor. Stock blinds are now available in 72 different widths and 3 colors. Because of the large inventory and display space required, small retailers can not afford to sell ready-made blinds. My invention eliminates the need for large inventories and yet provides a custom-looking blind that is easy to install. My invention requires only five different sizes per color to cover windows from 24 inches wide to 96 inches wide. Small retailers will be able to afford both the space and the dollars to stock my invention.

3. Disclosure Statement.

Moore, U.S. Pat. No. 1,949,653, issued Mar. 6, 1934; Norton, U.S. Pat No. 2,341,233, issued Feb. 8, 1944; and Moore, Jr., U.S. Pat. No. 2,837,152, issued June 3, 1958, each discloses a horizontally adjustable Venetian blind. However, my invention is simpler to manufacture, to install, and to use than the Venetian blind structure of Moore. Norton, or Moore, Jr. My invention uses existing blind components, operates the same and nearly looks the same as e xpensive custom Venetian blinds. My invention has a balanced look and has a profile which is more acceptable to the consumer than the Venetian blind structure of Moore, Norton, or Moore, Jr. My invention has a more pleasing appearance than any of them. My invention is a modern, attractive, and functional Venetian blind.

My invention is disclosed in document entitled "Disclosure Document", No. 128674, received in U.S. Pat. and Trademark Office on June 27, 1984.

SUMMARY OF THE INVENTION

This invention relates to a horizontally adjustable Venetian blind Only 5 adjustable blinds are needed to cover the size range now requiring 72 fixed blinds for each color. My invention provides a custom looking blind that is easy to install My invention provides an adjustable blind that uses exiting blind components, operate the same and nearly looks the same as the expensive custom Venetian blinds. My invention provides a new design that will appeal to the do it yourself consumer.

An object of this invention is to provide an adjustable Venetian blind which a consumer can easily install.

Another object of this invention is to provide an adjustable Venetian blind that will reduce the amount of inventory needed by a retailer. adjustable Venetian blind that is similar in appearance to present day Venetian blinds.

Still another object of this invention is to provide an adjustable Venetian blind that presents a modern, attractive appearance yet is functional A still further object of this invention is to provide an adjustable Venetian blind that can be assembled by existing workers without extensaive retraining Another object of this invention is to provide a adjustable Venetian blind that can be stocked by every hardware, flooring, paint, drapery, and variety store because of lower cost of inventory and smaller display area needed.

A further object of this invention is to provide an adjustable Venetian blind that will reduce storage costs for manufacturers.

Still another object of this invention is to provide an adjustable Venetian blind that is more salale or marketable because a smaller inventory is required by retailers and more color selection can be offered by retailers.

A still further object of this invention is to provide an adjustable Venetian blind that requires a smaller floor area to display and has a wider selection of colors to attract more consumers.

Another object of this invention is to provide an adjustable Venetian blind that will have entire inventory turnover more often.

A further object of this invention is to provide an adjustable Venetian blind that will have fewer returns because a consumer measured wrong and the blind does not fit.

Still another object of this invention is to provide an adjustable Venetian blind that may be sold with a minimum of effort as consumer just pick it up and go.

A still further object of this invention is to provide an adjustable Venetian blind that does not require any exact measurement by the consumer.

Another obje ct of this invention is to provide an adjustable Venetian blind that may be used for rentals.

A further object of this invention is to provide an adjustable Venetian blind that has a pleasing and modern appe arance.

Still another object of this invention is to provide an adjustable Venetian blind that is easy to install as no exact me asurement is required and locking tabs are used to fix the the blind in the desired width.

Other objects, features and advantages of the present invention will be readily apparent from the following detailed description taken in connection with the accompanying drawings.

DESCRIPTION OF THE PREFERRED EMBODIMENT

Before explaining the present invention in detail it is to be understood that the invention is not limited in its application to the details of construction and arrangements of parts illustrated in the accompanying drawings, since the invention is capable of other embodiments and of being practiced or carried out in various ways. Also, it is to be understood that the phraseology or terminology employed herein is for the purpose of description and not of limitations.

Figures 1, 2, 3:
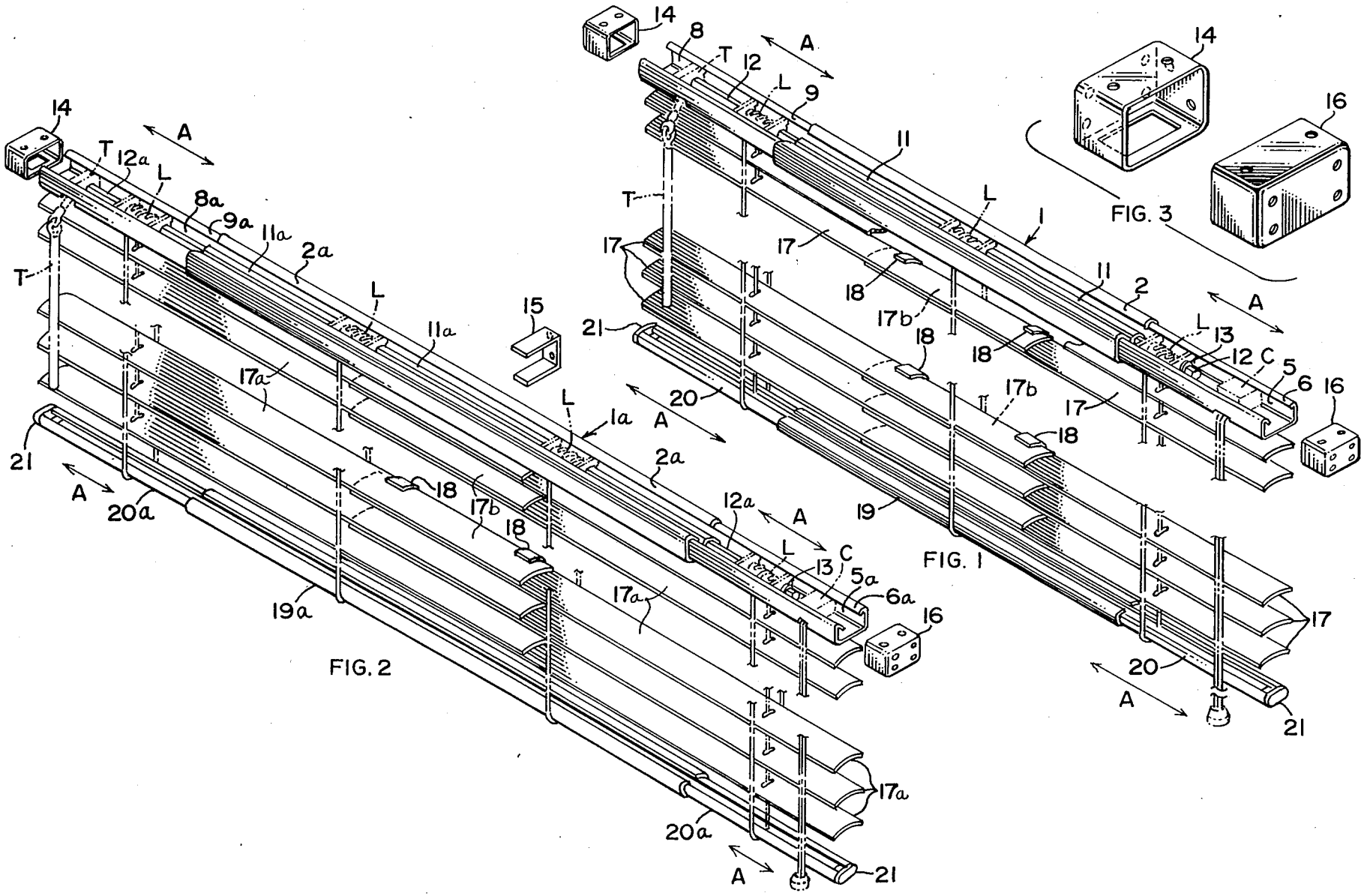
FIG. 1 is a perspective view of the adjustable Venetian blind with three ladders.
FIG. 2 is a perspective view of the adjustable Venetian blind with four ladders.
FIG. 3 is an enlarged perspective vie w of left and right support brackets.
Figures 4, 5, 6, 7, 8, 9, 10, 11, 12:
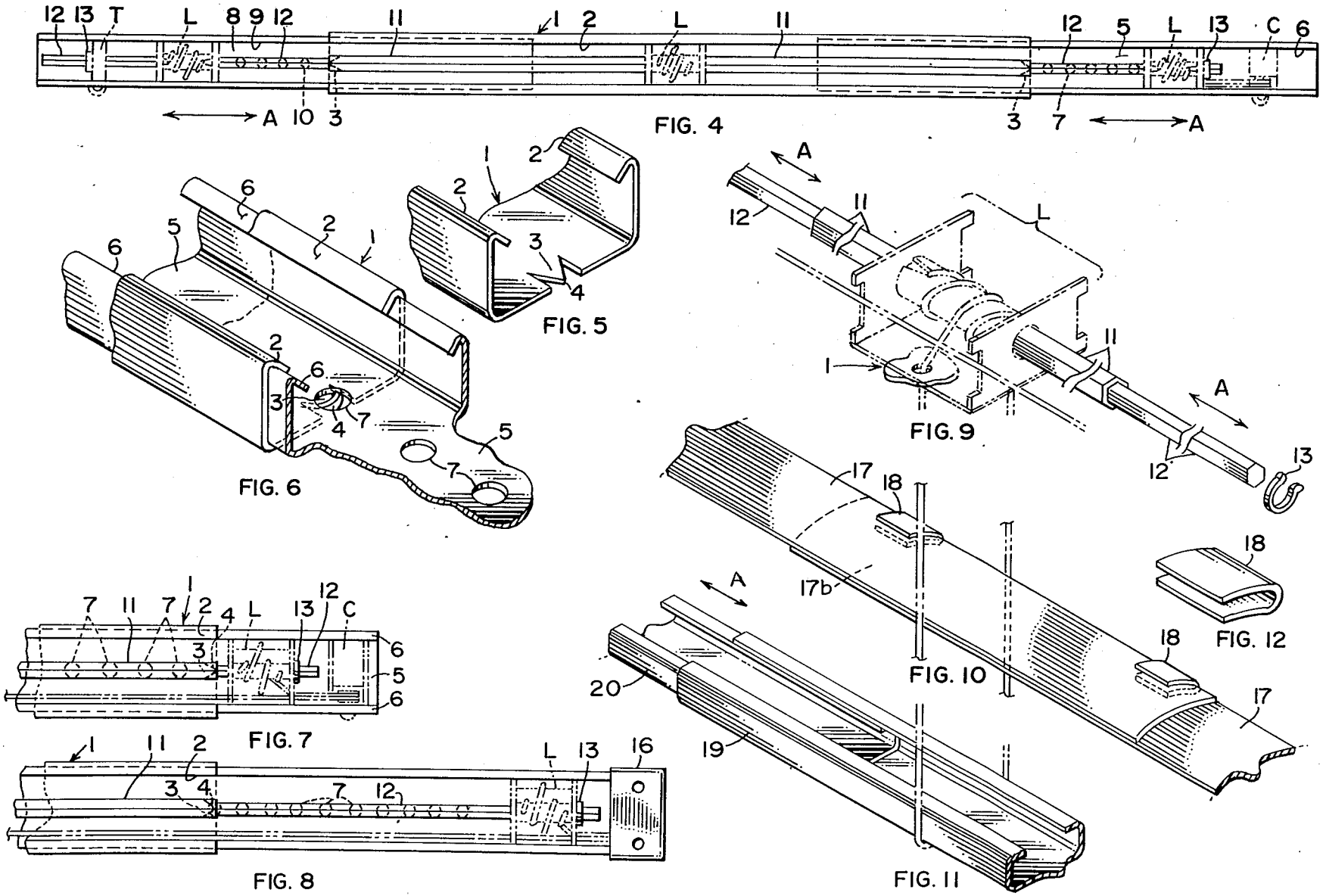
FIG. 4 is an enlarged plan view of head channel assembly.
FIG. 5 is an enlarged partial perspective view of central channel of head channel assembly showing a locking tab.
FIG. 6 is an enlarged partial perspective view of central channel and right channel of head channel assembly in locked position, locking tab is turned upward.
FIG. 7 is an enlarged partial plan view of central channel and right channel of head channel assembly in a compressed position.
FIG. 8 is an enlarged partial plan view of central channel and right channel of head channel assembly in an expanded position, with locking tab bent up.
FIG. 9 is an enlarged partial perspective view of tilt rod and ladder drum assembly.
FIG. 10 is an enlarged partial perspective view of slat assembly.
FIG. 11 is an enlarged partial perspective view of bottom rail assembly.
FIG. 12 is an enlarged perspective view of a slat clip.

Referring now to the drawings wherein like reference 1e tters and numerals refer to like and corresponding parts throughout the several views, the preferred embodiment of the invention is disclosed in FIGS. 1–12 inclusive.

The invention includes a head channel assembly, a tilt rod assembly, a slat assembly, and a bottom rail assembly The head channel assembly includes a central channel 1, a right channel 5, and a left channel 8. Central channel 1 includes a ridge 2 and two locking tabs 3 with tips 4. Right channel 5 includes a ridge 6 and holes 7. Left channel 8 include s a ridge 9 and holes 10. Central channel 1 is fractionally wider and deeper than right channel 5 and left channel 8 to allow a sliding movement without binding by right channel 5 and left channel 8 when assembled. Right channel 5 and left channel 8 are interchangeable, prior to assembly. Central channel 1 has locking tabs 3 with tips 4 at its ends. Right channel 5 has a series of holes 7 in its intermediate portion. Left channel 8 has a series of holes 10 in its intermediate portion. Ridges 2, 6, and 9 provide rigidity to the assembled head channel.

The tilt rod assembly includes tilt rod body 11, two tilt rod extensions 12, and two retaining clips 13. Tilt rod body 11 is fractionally wider and deeper than tilt rod extensions 12 to allow a sliding movement without binding when assembled. Tilt rod extensions 12 are telescoped within tilt rod body 11. The lengths of tilt rod body 11 and tilt rod extensions 12 are the same as the head channel assembly sections. Tilt rod body 11 and tilt rod extensions 12 may be of any shape that will allow horizontal sliding movement and yet interlock when rotated. The best embodiment is a 5 or 6 sided hollow tube for tilt rod body 11 and two similarly shaped solid rods for tilt rod extensions 12, to fit within tilt rod body 11. I prefer a hexagonal shape as it keeps the sections in unison when rotated or "tilted". See FIG. 9.

Tilt rod assembly is placed within the head channel assembly and each tilt rod extension 12 will slide with its head channel section when expanded. Tilt rod body 11 fits within at least one ladder drum assembly L and tilt rod extension 12 fits within a ladder drum assembly L. When tilt rod assembly is properly positioned within head channel assembly and within ladder drum assemblies L, retaining clips 13 are placed on the tilt rod extensions 12 near their outside end portions See FIG. 4. The retaining clips 13 prevent the tilt rod assembly from slipping out of place when the head channel assembly is being expanded to its desired width. Each tilt rod extension 12 will slide with its counterpart head channel section when expanded. The retaining clips 13 assure that the tilt rod extensions 12 telescope from tilt rod body 11 and do not slip out of the tilt rod body 11 or the ladder drum assembly L.

Slat assembly includes a series of slats 17 and slat clips 18. At each ladder rung are two slats 17 that overlap each other in an area that is shown by reference numeral **17*b*. The lengths of the individual slat 17 are equal and the cross sections are identical. A lift cord passes through each slat 17** on the outside ladders and aligns the slat with the head channel.

Two slat clips 18 align the two slats 17 in the overlapped area **17*b*. See FIG. 10. Slat clips 18 are one inch (2.54 cm.) wide and made of plastic. I prefer a clear color, but any color may be used. However, if it is deemed to be desirable that slat clips 18** not be noticeable, a color similar to the color of the slats may be used.

Slat clips 18 are placed on the slats 17 by the manufacturer on the window side of the blind. Slat clips 18 allow the blind to be expanded by the consumer during the initial installation. Slat clips 18 are placed in the area of slat overlap **17*b*. The consumer may align slat clips 18 after installation of the blind, if needed. Because the slat clips 18** are placed on the window side of the blind, they do not affect the looks from the room side.

Bottom rail assembly includes a bottom rail body 19, two bottom rail extensions 20, and two end caps 21. Bottom rail body 19 is fractionally wider and deeper than bottom rail extensions 28 to allow a sliding movement without binding when assembled. The bottom rail lengths are the same as the head channel assembly. The opened D-shape of the bottom rail assembly provides rigidity when assembled. See FIG. 11. The expandable bottom rail extensions 20 need no retaining clips or tabs as no pressure is exerted when the blind is raised or lowered or tilted.

Reference numerals 14, 15, and 16, denote left support bracket, center support bracket, and right support bracket, respectively.

Reference letter A denotes adjustment. Arrows show direction of movement. Reference letter L denotes ladder drum assembly. Reference letter C denotes lift cord lock assembly. Reference letter T denotes tilt control assembly.

Ladder drum assembly L, lift cord lock assembly $C_o$ and tilt control assembly T are conventional parts of a Venetian blind. They are drawn in phantoe in order to contrast them from the improvements.

Left support bracket 14 and right support bracket 16 are designed to work together as a pair in the installation of my invention Each support bracket is designed to be mounted with 2 screws in practically any installation position The left and right support brackets have an entrance in only one of its side and no front gate. The term "blind entrance" refers to the area of each support bracket which allows the blind to be inserted. In other words, the entrance in its side. The support brackets are an improvement over existing installation brackets as they do not have a front gate and are thus less expensive to manufacture My invention requires only 5 adjustable blinds to cover the size range now requiring 72 fixed blinds. These five sizes are 24–32 inches (60.96 cm.–81.28 cm.), 32–42 inches (81.28 cm.–106.68 cm.), 42–54 inches (106.68 cm.–137.16 cm.), 54–72 inches (137.16 cm.–182.88 cm.), and 72–96 inches (182.88 cm.–243.84 cm.). Three ladders are used for the 2 smaller sizes (see FIG. 1); four ladders are used for the 3 larger sizes of my invention (see FIG. 2). When any of the three larger sizes is used, a center support bracket 15 is required (42 inches or more). An "a" has been added to reference numerals of the larger sized parts in FIG. 2, e.g., 1*a*, 5*a*, 8*a*, 11*a*, 12*a*, 17*a*, and 19*a*.

The operation of my invention is as follows' (1) Consumer selects a size that covers the approximate size of window to be decorated (2) Consumer secures 1e ft support bracket and right support bracket where he wants on the window, no exact measurements is needed The support brackets are mounted where desired so long as they are level and are less than the maximum width of the blind. A center support bracket is mounted between the two support brackets, if one is included with the blind. (3) Consumer expands left and right channels of head channel assembly equally until the ends of the channels rests in the support brackets. (4) Consumer pushes up locking tab tips into corresponding holes 7 and 10 with an ice pick or a screwdriver to lock the width of the blind. The locking tab tips must be inserted into the corresponding hole or else when the lift cord is pulled to raise the blind, the cord pressure will cause the head channel assembly to slide back to its smalle st width. (5) Consumer loWe rs blind using lift cord. The ladders and lift cords will pull most of the slats to the same width of the head channel assembly. (6) Consumer adjusts width of bottom rail assembly and slats, if necessary to width of the head channel assembly.

My invention looks like the blinds being made in factories today. The components are similar to present day blinds. My invention can be assembled by existing workers without extensive retraining. No new technology is required to produce the components for my invention.

Existing components can be used by the Venetian blind manufacturers so that they won't lose money on their existing inventory. The different components needed for my invention for central channel and tilt rod body are merely different sized of existing stock. An adjustable drapery rod may be used for bottom rail assembly.

The single new item is the slat clip. It can be made of plastic or metal with existing technology. All that is needed is a new mold.

My invention will be accepted by the consumer because it looks like the blind he has been buying. The 3-piece head channel assembly and bottom rail assembly present a pleasing appearance. Unlike a 2-piece Venetian blind where the overlapped area is usually off center, the 3-piece construction of the head channel assembly and bottom rail assembly of my invention allow the consumer to adjust the Venetian blind so that the center section is in the middle of the area to be covered. The faint line at the overlapping area of the double slats is barley discernible. The slat clips which keep the double slats aligned can be made of clear plastic or of the same color as the slats. Thus the overall effect of my invention is a modern, attractive, and functional Venetian blind.

My invention is a width adjustable Venetian blind which is freely extendable between limits. It will reduce the amount of inventory that a retailer must stock and yet provide a custom-looking blind that is easy to install. It will provide a Venetian blind that presents a modern, attractive appearance, yet is functional.

Although but a single embodiment of the invention has been disclosed and described herein, it is obvious that many changes may be made in the size, shape, arrangements, color and detail of the various elements of the invention without departing from the scope of the novel concepts of the present invention.

I claim as my invention:

1. An adjustable Venetian blind comprising a head channel assembly, a tilt rod assembly, a slat assembly, and a bottom rail assembly; the head channel assembly includes a central channel, a right channel and a left channel, with a portion of the right channel and of the left channel being slidable within the central channel, and means to secure the right and left channels to the central channel; the tilt for assembly is a body and two tilt rod extensions, with a portion of the tilt rod extensions be ing slidable within the tilt rod body, and means to retain the tilt rod assembly in the head channel assembly; the slat assembly includes a series of vertically spaced slats, each of the slats includes two slat components which overlap each other and which are slidably secured to each other by two slat clips; the bottom rail assembly include s a bottom rail body and two bottom rail extensions, with a portion of the bottom rail extensions being slidable within the bottom rail body; and means for pivoting said tilt rod assembly and means for raising and lowering the bottom rail assembly and the slat assembly.

2. The adjustable Ventetian blind of claim 1, wherin the blind is installed within two support brackets, which have a blind entrance in only one of the sides of each support bracket.

3. The adjustable Venetian blind of claim 1, wherein there are at least three ladder drum assemblies that are axially spaced from each other on the tilt rod assembly with at least three ladders depending therefrom, each ladder supporting the slats on its connecting rungs and the bottom rail assembly is connected to the ends of the ladders.

4. An adjustable Venetian blind comprising a head channel assembly, a tilt rod assembly, a slat assembly, and a bottom rail assembly; the head channel assembly includes a central channel, a right channel and a left channel, with a portion of the right channel and of the left channel being slidable within a central channel, and means to secure the right and left channels to the central channel includes a locking tab on each end of the central channel and a series of spaced holes in the intermediate portions of the right and left channels, a locking tab is inserted into a hole in the right and left channels after the head channel assembly is at its proper width; the tilt rod assembly includes a tilt rod body and two tilt rod extensions, with a portion of the tilt rod extension being slidable within the tilt rod body, and means to retain the tilt rod assembly in the head channel assembly; the slat assembly includes a series of vertically spaced slats, each of the slats includes two slat components which overlap each other and which are slidably secured to each other by two slat clips; the bottom rail assembly includes a bottom rail body and two bottom rail extensions, with a portion of the bottom rail extensions being slidable within the bottom rail body; means for pivoting said tilt rod assembly and means for raising and lowering the bottom rail assembly and the slat assembly; and there are at least three ladder drum assemblies that are axially spaced from each other on the tilt rod assembly with at least three ladders depending therefrom, each ladder supporting the slats on its connecting rungs and the bottom rail assembly is connected to the ends of the ladders.

5. The adjustable Venetian blind of claim 4, wherein the means to retain the tilt rod assembly in the head channel assembly includes two retaining clips which are placed on the tilt rod extensions near their outside end portions.

6. The adjustable Venetian blind of claim 5, wherein the blind is installed within two support brackets, which have a blind entrance in one of its side.

7. The adjustable Venetian blind of claim 5, in combination with a left support bracket and a right support bracket at its ends, and a center support bracket at its middle for installation to a surface; the left and right support brackets have an entrance in one of its side and no front gate.

* * * * *